US007960086B2

(12) United States Patent
Aoki et al.

(10) Patent No.: US 7,960,086 B2
(45) Date of Patent: Jun. 14, 2011

(54) DEVELOPING AGENT AND METHOD FOR MANUFACTURING THE SAME

(75) Inventors: Takayasu Aoki, Mishima (JP); Takashi Urabe, Sunto-gun (JP); Takafumi Hara, Mishima (JP); Tsuyoshi Itou, Izunokuni (JP); Masahiro Ikuta, Mishima (JP); Motonari Udo, Mishima (JP); Yasuhito Noda, Mishima (JP); Satoshi Araki, Izunokuni (JP); Asumi Matsumoto, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 344 days.

(21) Appl. No.: 12/266,260

(22) Filed: Nov. 6, 2008

(65) Prior Publication Data

US 2009/0130585 A1 May 21, 2009

Related U.S. Application Data

(60) Provisional application No. 60/988,355, filed on Nov. 15, 2007, provisional application No. 61/046,154, filed on Apr. 18, 2008.

(51) Int. Cl.
*G03G 9/08* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS

2007/0281240 A1 12/2007 Urabe et al.

FOREIGN PATENT DOCUMENTS

| | | |
|---|---|---|
| JP | 09-311502 | 12/1997 |
| JP | 2007-033769 | 2/2007 |
| JP | 2007-106906 | 4/2007 |
| JP | 2007-114665 | 5/2007 |
| JP | 2007-187917 | 7/2007 |

OTHER PUBLICATIONS

Abstract of JP 2007279195 Oct. 25, 2007.*

* cited by examiner

*Primary Examiner* — Hoa V Le
(74) *Attorney, Agent, or Firm* — Turocy & Watson, LLP

(57) ABSTRACT

A coarse particle containing a polyester based resin and a coloring agent is added in an aqueous medium containing a surfactant, a basic substance and an inorganic water-soluble electrolyte, and dispersion and coagulation are carried out to form a toner particle.

7 Claims, 1 Drawing Sheet

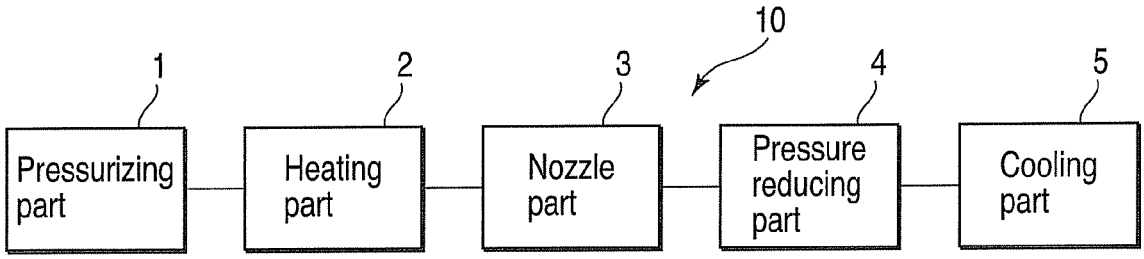
FIGURE

DEVELOPING AGENT AND METHOD FOR MANUFACTURING THE SAME

CROSS-REFERENCE TO RELATED APPLICATION

This application is based upon and claims the benefit of priority from U.S. Provisional Applications No. 60/988,355, filed Nov. 15, 2007 and No. 61/046,154, filed Apr. 18, 2008, the entire contents of which are incorporated herein by reference.

TECHNICAL FIELD

The present invention relates to a developing agent for developing an electrostatic charge image or a magnetic latent image in an electrophotographic method, an electrostatic printing method or the like and to a method for manufacturing the same.

BACKGROUND

As to polymerization toners, a system using a styrene based resin as a binder resin has hitherto been the mainstream. But, from the viewpoints of low-temperature fixability, etc., in recent years, a chemical toner using a polyester based resin has been extensively and intensively investigated. However, in general, the polyester based resin is not obtainable through emulsion polymerization, and therefore, a polyester based emulsion has been obtained by phase conversion emulsification using an organic solvent or a method by a special emulsification-dispersion machine.

In general, in the chemical toner, after a manufacturing step of an atomized liquid, coagulation and fusion steps are carried out. However, there is involved a defect that the process is complicated because plural steps are undergone. For example, Japanese Patent No. 3351505 describes that an emulsion of a polyester based resin is obtained by introducing a molten resin into a high-speed rotation type continuous emulsification-dispersion machine. However, the apparatus is complicated, and there is risk that deterioration of the polyester resin occurs. Also, JP-A-2007-114665 describes the use of an organic solvent for dissolving a polyester therein. However, equipment for recovering the organic solvent is required, and a load to the environment is large. In addition, JP-A-2007-33769 involved problems that since a polycondensation reaction is carried out in water, not only a special technology is required, but it is difficult to increase the molecular weight. In addition, JP-A-2007-106906 describes that emulsification is carried out at a temperature of not higher than a softening point of the resin. However, there are involved problems that a dispersed particle does not become sufficiently small and that control of the particle size is difficult. In addition, JP-A-2007-187917 describes that a toner particle is formed without undergoing a coagulation step. However, there is involved a problem that control of the average particle size or particle size distribution is difficult.

SUMMARY

An object of the invention is to provide a method for manufacturing a developing agent with a uniform particle size using a polyester based resin binder without using an organic solvent.

In the method for manufacturing a developing agent according to the invention, a coarse particle containing a polyester based resin and a coloring agent is dispersed in an aqueous medium containing a surfactant, a basic substance and an inorganic water-soluble electrolyte to prepare a dispersion, and dispersion and coagulation of the coarse particle are carried out in a single step, thereby forming a toner particle.

The developing agent according to the invention has a toner particle which is obtained by dispersing a coarse particle containing a polyester based resin and a coloring agent in an aqueous medium containing a surfactant, a basic substance and an inorganic water-soluble electrolyte to prepare a dispersion and carrying out dispersion and coagulation of the coarse particle and which has a volume average particle size of from 2 to 10 μm and a CV value as obtained by dividing a standard deviation σ of the volume average particle size by the volume average particle size of not more than 30%.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWING

The accompanying drawing, which is incorporated in and constitutes a part of the specification, illustrates embodiments of the invention, and together with the general description given above and the detailed description of the embodiments given below, serves to explain the principles of the invention.

The single FIGURE is a diagrammatic view expressing an example of a high-pressure homogenizer to be used in the invention.

DETAILED DESCRIPTION

The invention is concerned with a method for manufacturing a developing agent comprising dispersing a coarse particle containing a polyester based resin and a coloring agent in an aqueous medium and coagulating the coarse particle to form a toner particle, wherein the coarse particle is dispersed and coagulated in the aqueous medium having a surfactant, a basic substance and an inorganic water-soluble electrolyte added therein in advance, thereby forming a toner particle.

According to the invention, in dispersing a coarse particle containing a polyester based resin and a coloring agent without using an organic solvent, an inorganic water-soluble electrolyte is added in advance together with a surfactant and a basic substance in the aqueous medium, and dispersion and coagulation of the coarse particle are carried out by a single action, whereby a toner particle can be formed.

The obtained toner particle can be easily separated from the aqueous medium and dried.

(Inorganic Water-Soluble Electrolyte)

As the inorganic water-soluble electrolyte to be used in the invention, a monovalent salt of an inorganic water-soluble electrolyte is preferable. Examples of the monovalent salt include inorganic metal salts and ammonium salts. Examples of the inorganic metal salt include sodium chloride and potassium chloride. Examples of the ammonium salt include ammonium chloride, ammonium sulfate, ammonium acetate, ammonium hydrogensulfate and ammonium dihydrogenphosphate. Of these, ammonium chloride which is cheaply available and excellent in coagulation performance is especially preferable.

(Manufacturing Apparatus of Resin Dispersion)

In the invention, emulsification of the polyester based resin can be carried out in a general chemical reactor. As a stirring blade, a turbine blade, a paddle blade, a Pfaudler blade, a bull margin blade and the like can be used. When the viscosity of the emulsion is high, high-viscosity blades such as a Maxblend blade, a Fullzone blade and a helical ribbon blade can be used. Alternatively, for the purpose of more effectively dispersing the resin in a solvent of the resin, a dispersion machine such as a homogenizer can be used.

As the homogenizer, a high-pressure homogenizer for passing a dispersion through a pressure-resistant nozzle under heating and pressure can be used.

Examples of the high-pressure homogenizer which can be used in the invention include a Manton-Gaulin type high-pressure homogenizer (manufactured by Niro Soavi), MICROFLUIDIZER (manufactured by Mizuho Industrial Co., Ltd.), NANO-MIZER (manufactured by Nano-Mizer), ULTIMIZER (manufactured by Sugino Machine Limited), GENUS PY (manufactured by Hakusui Chemical Industries, Ltd.) and NANO3000 (manufactured by Biryu Co., Ltd.).

The high-pressure homogenizer includes, for example, a pressurizing part and a pressure reducing part.

FIGURE is a diagrammatic view expressing an example of a high-pressure homogenizer to be used in the invention.

As illustrated in FIGURE, a high-pressure homogenizer 10 includes a pressure rising part 1, a heating part 2, a nozzle part 3, a pressure reducing part 4 and a cooling part 5.

In the high-pressure homogenizer 10, a dispersion containing an aqueous medium containing a surfactant, a basic substance and an inorganic water-soluble electrolyte therein in advance and a coarse particle containing a polyester based resin and a coloring agent is introduced into the pressure rising part 1; pressurized by a non-illustrated pump, sent to the heating part 2 and heated; subsequently introduced into the pressure-resistant nozzle part 3 having a narrow space and passed therethrough at a high speed; sent to the pressure reducing part 4; and thereafter, cooled in the cooling part 5.

When the dispersion is passed through the high-pressure homogenizer 10, a high pressure difference is locally generated in the nozzle part 3. The heated resin coarse particle which is a dispersed phase in the dispersion is torn and atomized due to this pressure difference.

In the pressure reducing part, when after reaching a maximum pressure in the nozzle part, the pressure is, for example, reduced in a stepwise manner, coagulation properties of the fine particle can be controlled. Also, when cooling is carried out after reducing the pressure, stability of the treatment increases, and therefore, such is preferable.

A treatment pressure is desirably from 60 to 200 MPa, and especially desirably from 100 to 150 MPa. A heating temperature is desirably from 120° C. to 200° C., and especially from 150 to 190° C.

It is preferable from the standpoint of stability of the treatment that after passing through the nozzle, the pressure is gradually reduced.

When a prescribed particle size is not obtainable by single-pass passage, the prescribed particle size may be obtained through a treatment of from two-pass to ten-pass passage.

A volume average particle size of the toner particle is preferably from 2 to 10 μm.

When the volume average particle size of the toner particle is less than 2 μm, there is a tendency that the charge quantity cannot be well controlled according to the current electrophotographic system; and when it exceeds 10 μm, a high image quality cannot be realized.

Also, a CV value which expresses the particle size distribution is preferably not more than 30%.

When the CV value exceeds 30%, a proportion of the coarse particle component and the fine powder component is high so that deterioration of an image or toner flying tends to occur.

The CV value can be calculated in the following manner.

$CV(\%)$=(Standard deviation σ of particle size distribution on the basis of volume average particle size)/(Volume average particle size)

The standard deviation σ can be obtained from a square root (square root of dispersion) of a value obtained by dividing the total sum of squares in a difference between each data and the average value by the data number.

CV is preferably not more than 25% and may be practically usefully 15% or more.

As the binder resin to be used in the invention, for example, a polyester based resin obtained through esterification of a dicarboxylic acid component and a diol component and subsequent polycondensation.

Examples of the acid component include aromatic dicarboxylic acids such as terephthalic acid, phthalic acid and isophthalic acid; and aliphatic carboxylic acids such as fumaric acid, maleic acid, succinic acid, adipic acid, sebacic acid, glutaric acid, pimelic acid, oxalic acid, malonic acid, citraconic acid and itaconic acid.

Examples of the alcohol component include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane and pentaerythritol; alicyclic diols such as 1,4-cyclohexanediol and 1,4-cyclohexanedimethanol; and ethylene oxide or propylene oxide adducts such as bisphenol A.

Also, the foregoing polyester component may be converted so as to have a crosslinking structure by using a tribasic or polybasic carboxylic acid or polyhydric alcohol component such as 1,2,4-benzenetricarboxylic acid (trimellitic acid) or glycerin.

Two or more kinds of polyester resins having a different composition may be mixed and used.

Also, from the viewpoint of the low-temperature fixability, it is preferable that the foregoing polyester resin is amorphous such that it is easy to control a glass transition temperature thereof.

The glass transition temperature of the polyester resin is desirably 45° C. or higher and not higher than 70° C., and more desirably 50° C. or higher and not higher than 65° C. When the glass transition temperature is lower than 45° C., heat-resistant storage properties of the toner are deteriorated; and when it is higher than 70° C., low-temperature fixability tends to be deteriorated. When a temperature of a fixing unit of an image forming apparatus to be used is from 100° C. to 180° C., if a softening point of the polyester resin is in the range of from 80 to 140° C., offset resistance tends to become satisfactory.

An acid value of the polyester resin is preferably from 1.0 to 25.0 mg KOH/g.

When the acid value of the polyester resin is less than 0.1 mg KOH/g or exceeds 25.0 mg KOH/g, charge properties against a change of the environment tend to be not stable.

A weight average molecular weight Mw of the polyester resin is preferably 5,000 or more and not more than 50,000.

When the weight average molecular weight Mw of the polyester resin is less than 5,000, elasticity of the toner is lowered, whereby high-temperature offset properties tend to be deteriorated; and when it exceeds 50,000, low-temperature fixability tends to be deteriorated.

The weight average molecular weight Mw of the polyester resin is more preferably 8,000 or more and not more than 20,000.

(Release Agent Component)

In the invention, a release agent component can be blended in the binder resin. Examples of the release agent include aliphatic hydrocarbon based waxes such as low molecular weight polyethylene, low molecular weight polypropylene, polyolefin copolymers, polyolefin waxes, paraffin waxes and Fischer-Tropsch waxes and modified materials thereof; vegetable waxes such as candelilla wax, carnauba wax, Japan wax, jojoba wax and rice wax; animal waxes such as bees wax, lanolin and whale wax; mineral waxes such as montan wax, ozokerite and ceresin; fatty acid amides such as linoleic acid amide, oleic acid amide and lauric acid amide; and silicone based waxes.

In the invention, the release agent is especially preferably one having an ester bond and composed of an alcohol component and a carboxylic acid component. Examples of the alcohol component include higher alcohols; and examples of the carboxylic acid component include saturated fatty acids having a linear alkyl group; unsaturated fatty acids such as monoenoic acids and polyenoic acids; and hydroxy fatty acids. Also, examples of unsaturated polybasic carboxylic acids include maleic acid, phthalic acid, fumaric acid, succinic acid and itaconic acid. Anhydrides thereof may also be used. From the viewpoint of low-temperature fixability, a melting point of the release agent is desirably from 60° C. to 120° C., and more desirably from 70° C. to 110° C.

(Coloring Agent)

As the coloring agent to be used in the invention, carbon black or organic or inorganic pigments or dyes are useful. Though there are no particular limitations, examples of the carbon black include acetylene black, furnace black, thermal black, channel black and ketjen black. Examples of the pigment or dye include Fast Yellow G, Benzidine Yellow, Indo Fast Orange, Irgazin Red, Naphtholazo, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green and quinacridone. These materials can be used singly or in admixture.

(Charge Controlling Agent)

In the invention, a charge controlling agent for controlling a triboelectrostatic charge quantity or the like may be blended. As the charge controlling agent, a metal-containing azo compound is useful, and complexes or complex salts whose metal element is iron, cobalt or chromium, or mixtures thereof are desirable. Also, a metal-containing salicylic acid derivative compound is useful, and complexes or complex salts whose metal element is zirconium, zinc, chromium or boron, or mixtures thereof are desirable.

(External Additive)

In the invention, in order to regulate fluidity or charge properties against the toner particle, an inorganic fine particle may be externally added and mixed in an amount of from 0.01 to 20% by weight relative to the toner particle. As such an inorganic fine particle, silica, titania, alumina, strontium titanate, tin oxide and the like can be used singly or in admixture of two or more kinds thereof. From the viewpoint of enhancing environmental stability, it is preferable to use an inorganic fine particle having been subjected to a surface treatment with a hydrophobic agent. Also, in addition to such an inorganic oxide, a resin fine particle of not larger than 1 μm, for example, a fine particle of a resin such as a polysiloxane resin may be externally added for the purpose of enhancing cleaning properties.

(Surfactant)

In the invention, in a step of emulsification dispersion of the polyester based resin, a surfactant is used.

Examples of an anionic surfactant include sulfonic acid salts such as alkylbenzenesulfonic acid salts, alkylnaphthalenesulfonic acid salts, alkyldiphenyl ether disulfonic acid salts and alkanesulfonic acid salts; fatty acid salts such as oleic acid salts, stearic acid salts and palmitic acid salts; sulfuric acid ester salts such as a lauryl sulfate salt and a lauryl ether sulfate salt; and alkenylsuccinic acid salts.

Examples of a cationic surfactant include amine salts such as laurylamine salts, oleylamine salts and stearylamine salts; and quaternary ammonium salts such as a lauryltrimethylammonium salt, a stearyltrimethylammonium salt, a distearyldimethylammonium salt and an alkylbenzyldimethylammonium salt.

Examples of a nonionic surfactant include polyoxyethylene alkyl ethers such as polyoxyethylene lauryl ether, polyoxyethylene stearyl ether and polyoxyethylene myristyl ether; polyoxyalkylene alkyl ethers such as polyoxyethylene alkylene alkyl ethers and polyoxyethylene polyoxypropylene glycol; and sorbitan fatty acid esters such as sorbitan monolaurate, sorbitan monopalmitate and sorbitan monostearate.

The use amount of the surfactant is desirably from 1.0% by weight to 10% by weight relative to the weight of the solids of the toner component in the dispersion. As to the kind of the surfactant, the anionic surfactant is the most desirable from the viewpoints of dispersibility and coagulation properties. It is not preferable to use a nonionic soap singly because though it is excellent in dispersibility, it tends to be difficultly coagulated.

(Basic Substance)

In the invention, in a step of emulsification dispersion of the polyester based resin, a basic substance is used.

Examples of the basic substance include alkali metal hydroxides such as sodium hydroxide, potassium hydroxide and lithium hydroxide; and amines such as ammonia water, methylamine, dimethylamine, triethylamine, ethylamine, dimethylaminoethanol, diethylaminoethanol, diethanolamine, triethanolamine and morpholine. Of these, amines are especially preferable from the viewpoint of an emulsification dispersion effect of the polyester based resin.

EXAMPLES

The invention is specifically described below with reference to the following Examples.

(Production of Amorphous Polyester Resin A)

39 parts by weight of terephthalic acid, 61 parts by weight of an ethylene oxide compound of bisphenol A and 0.2 parts by weight of dibutyltin were thrown into an esterification reaction vessel and subjected to a polycondensation reaction at 260° C. and 50 kPa for 5 hours under a nitrogen atmosphere, thereby obtaining a polyester resin. A glass transition temperature Tg was 60° C., a softening point was 110° C., and a weight average molecular weight was 12,000.

Example 1

90 parts by weight of the amorphous polyester resin A, 5 parts by weight of rice wax as a release agent and 5 parts by weight of a cyan pigment were kneaded in a twin-screw kneader, and the kneaded mixture was pulverized to obtain a coarsely pulverized material of toner. 100 parts by weight of this coarsely pulverized material of toner, 1.0 part by weight of an anionic surfactant, NEOGEN R (manufactured by Daiichi Kogyo Seiyaku Co., Ltd.) as a surfactant, 2.1 parts by weight of dimethylaminoethanol (DMAE), 2 parts by weight of ammonium chloride and 566 parts by weight of deionized water were added, and the mixture was thoroughly stirred while deaerating in vacuo. This polyester coarsely pulverized slurry was passed through a high-pressure homogenizer (NANO3000, manufactured by Biryu Co., Ltd.) to form a toner particle.

As illustrated in FIGURE, the apparatus is composed of a pressure rising part, a heating part, a nozzle part, a pressure reducing part and a cooling part. The operation was carried out under conditions of a treatment pressure of 150 MPa, a liquid temperature of the heating part of 190° C., a nozzle size of 0.125 mm and a treatment amount of 20 L/H. The slurry was repeatedly circulated three times in this apparatus. As a result of measurement by a Coulter counter particle size analyzer (manufactured by Beckman Coulter Inc.), a toner particle having a volume average particle size of 5.5 μm was obtained. The obtained particle was sufficiently fused. A CV value expressing the distribution [(standard deviation of volume average particle size distribution)/(volume average particle size)] was 22%.

After cooling, the obtained colored particle was washed by a centrifuge until the washing water had a conductivity of 50 μS/cm and dried by a vacuum dryer until the water content reached 0.3% by weight. After drying, 2 parts by weight of hydrophobic silica (RX-200, manufactured by Nippon Aerosil Co., Ltd.) and 0.5 parts by weight of titanium oxide (STT-30EHJ, manufactured by Titan Kogyo K.K.) were deposited on the colored particle surface, whereby a desired electrophotographic toner could be obtained.

The obtained results are shown in the following table.

Example 2

100 parts by weight of the same coarsely pulverized material of toner as in Example 1, 1.0 part by weight of an anionic surfactant, NEOGEN R (manufactured by Dai-ichi Kogyo Seiyaku Co., Ltd.) and 0.5 part by weight of a nonionic surfactant, NOIGEN XL-140 (manufactured by Dai-ichi Kogyo Seiyaku Co., Ltd.) as surfactants, 2.1 parts by weight of dimethylaminoethanol, 3 parts by weight of ammonium sulfate and 566 parts by weight of deionized water were added, and the mixture was thoroughly stirred while deaerating in vacuo. This polyester coarsely pulverized slurry was passed through the same high-pressure homogenizer (NANO3000, manufactured by Biryu Co., Ltd.) as in Example 1, thereby forming a toner particle. The slurry corresponding to three-pass passage was circulated in this apparatus, thereby obtaining a toner particle having a volume average particle size of 4.7 μm as measured by a Coulter counter particle size analyzer. The obtained particle was sufficiently fused. A CV value expressing the distribution was 21%.

After cooling, the obtained colored particle was washed by a centrifuge until the washing water had a conductivity of 50 μS/cm and dried by a vacuum dryer until the water content reached 0.3% by weight. Thereafter, washing and drying were carried out in the same manner as in Example 1, and hydrophobic silica and titanium oxide were externally added, whereby a desired electrophotographic toner could be obtained.

The obtained results are shown in the following table.

Example 3

100 parts by weight of the same coarsely pulverized material of toner as in Example 1, 3 parts by weight of an anionic surfactant, NEOGEN R (manufactured by Dai-ichi Kogyo Seiyaku Co., Ltd.) and 3 parts by weight of a nonionic surfactant, NOIGEN XL-140 (manufactured by Dai-ichi Kogyo Seiyaku Co., Ltd.) as surfactants, 2.1 parts by weight of dimethylaminoethanol, 3.0 parts by weight of ammonium chloride and 70 parts by weight of deionized water were added; the temperature was raised to 115° C. in a one-liter stirring vessel equipped with a max blend blade, and the mixture was stirred at a stirring blade revolution number of 300 rpm for 2 hours. Thereafter, 80 parts by weight of deionized water was continuously added dropwise over one hour. The mixture was cooled to ordinary temperature to produce an emulsified dispersion. As a result of measurement by a Coulter counter, the dispersion had a volume average particle size of 6.3 μm and a CV value expressing the distribution of 25%. Thereafter, washing and drying were carried out in the same manner as in Example 1, and hydrophobic silica and titanium oxide were externally added, whereby a desired electrophotographic toner could be obtained.

The obtained results are shown in the following table.

Comparative Example 1

90 parts by weight of the amorphous polyester resin A, 5 parts by weight of rice wax as a release agent and 5 parts by weight of a cyan pigment were kneaded in a twin-screw kneader, and the kneaded mixture was pulverized to obtain a coarsely pulverized material of toner. 100 parts by weight of this coarsely pulverized material of toner, 1.5 parts by weight of an anionic surfactant, NEOGEN R (manufactured by Dai-ichi Kogyo Seiyaku Co., Ltd.) and 1.5 parts by weight of a nonionic surfactant, HI-TENOL EA-177 (manufactured by Dai-ichi Kogyo Seiyaku Co., Ltd.) as surfactants, 1.1 parts by weight of potassium hydroxide and 70 parts by weight of deionized water were added, the temperature was raised to 115° C. in a one-liter stirring vessel equipped with a max blend blade, and the mixture was stirred at a stirring blade revolution number of 300 rpm for 2 hours. Thereafter, 80 parts by weight of deionized water was continuously added dropwise at 95° C. over one hour. Thereafter, the mixture was cooled to ordinary temperature. In the dispersion, solids remained, and a uniform dispersion was not obtainable.

The obtained results are shown in the following table.

Comparative Example 2

100 parts by weight of the same coarsely pulverized material of toner as in Example 1, 1.0 part by weight of a nonionic surfactant, NOIGEN XL-140 (manufactured by Dai-ichi Kogyo Seiyaku Co., Ltd.) as a surfactant, 2.1 parts by weight of dimethylaminoethanol, 3 parts by weight of ammonium chloride and 566 parts by weight of deionized water were added, and the mixture was thoroughly stirred while deaerating in vacuo. This polyester coarsely pulverized slurry was passed through the same high-pressure homogenizer (NANO3000, manufactured by Biryu Co., Ltd.) as in Example 1. The slurry corresponding to ten-pass passage was circulated in this apparatus. However, as a result of measurement by a Coulter counter particle size analyzer, the obtained particle had a volume average particle size of 0.54 μm so that it did not sufficiently grow as a toner.

The obtained results are shown in the following table.

Comparative Example 3

100 parts by weight of the same coarsely pulverized material of toner as in Example 1, 1.5 parts by weight of an anionic surfactant, NEOGEN R (manufactured by Dai-ichi Kogyo Seiyaku Co., Ltd.) and 1.5 parts by weight of a nonionic surfactant, HI-TENOL EA-177 (manufactured by Dai-ichi Kogyo Seiyaku Co., Ltd.) as surfactants, 1.5 parts by weight of calcium carbonate, 2.1 parts by weight of dimethylaminoethanol and 70 parts by weight of deionized water were added, the temperature was raised to 115° C. in a one-liter stirring vessel equipped with a max blend blade, and the mixture was stirred at a stirring blade revolution number of 300 rpm for 2 hours. Thereafter, 80 parts by weight of deionized water was continuously added dropwise over one hour. The mixture was cooled to ordinary temperature to produce a dispersion. As a result of measurement by a Coulter counter, the dispersion had a volume average particle size of 23 μm and had a CV value of 85% so that its particle size distribution was very broad.

The obtained results are shown in the following table.

TABLE

| | Example 1 | Example 2 | Example 3 | Comparative Example 1 | Comparative Example 2 | Comparative Example 3 |
|---|---|---|---|---|---|---|
| Apparatus | High-pressure homogenizer | High-pressure homogenizer | Pressure vessel | Pressure vessel | High-pressure homogenizer | Pressure vessel |
| Surfactant | Anionic surfactant | Anionic surfactant and nonionic surfactant | Anionic surfactant and nonionic surfactant | Anionic surfactant and nonionic surfactant | Nonionic surfactant | Anionic surfactant and nonionic surfactant |
| Electrolyte | Ammonium chloride | Ammonium sulfate | Ammonium chloride | — | Ammonium chloride | $CaCO_3$ |
| Basic substance | DMAE | DMAE | DMAE | KOH | DMAE | DMAE |
| Volume average particle size | 5.5 μm | 4.7 μm | 6.3 μm | Solids remained. Measurement was impossible. | 0.54 μm | 23 μm |
| CV value | 22% | 21% | 25% | — | — | 85% |

In the table, DMAE stands for dimethylaminoethanol; and KOH stands for potassium hydroxide.

In the light of the above, according to the invention, it is possible to manufacture an electrophotographic toner with sharp particle size distribution through a simple step.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for manufacturing a developing agent comprising preparing an aqueous medium containing a surfactant, a basic substance and an inorganic water-soluble electrolyte in advance, adding a coarse particle containing a polyester based resin and a coloring agent to the aqueous medium and carrying out dispersion and coagulation to form a toner particle.

2. The method according to claim 1, wherein the dispersion and coagulation are carried out by passing the dispersion through a high-pressure homogenizer including a pressurizing part and a pressure reducing part.

3. The method according to claim 2, wherein the high-pressure homogenizer includes a pressure rising part, a heating part, a nozzle part, a pressure reducing part and a cooling part.

4. The method according to claim 1, wherein the basic substance is an amine based compound.

5. The method according to claim 1, wherein the inorganic water-soluble electrolyte is a monovalent salt of an inorganic water-soluble electrolyte.

6. The method according to claim 5, wherein the monovalent salt of an inorganic water-soluble electrolyte is selected from the group consisting of sodium chloride, potassium chloride, ammonium chloride, ammonium sulfate, ammonium acetate, ammonium hydrogensulfate and ammonium dihydrogenphosphate.

7. The method according to claim 1, wherein the surfactant contains an anionic surfactant.

* * * * *